United States Patent [19]

Sheldon

[11] Patent Number: 4,730,871

[45] Date of Patent: Mar. 15, 1988

[54] ADJUSTABLE BACK REST

[75] Inventor: Samuel Sheldon, Marblehead, Mass.

[73] Assignee: Nepsco, Inc., Holliston, Mass.

[21] Appl. No.: 896,432

[22] Filed: Aug. 14, 1986

[51] Int. Cl.[4] ..... A47C 7/02

[52] U.S. Cl. ..... 297/230; 297/284; 297/460

[58] Field of Search ..... 297/284, 460, 230, 231

[56] References Cited

U.S. PATENT DOCUMENTS

| | | | |
|---|---|---|---|
| 1,264,265 | 4/1918 | Brusius | 297/284 |
| 2,991,124 | 7/1961 | Schwarz | 297/284 |
| 3,596,990 | 8/1971 | Gottfried et al. | 297/284 |
| 3,642,319 | 2/1972 | Berchicci | 297/284 |
| 4,097,087 | 6/1978 | Garavaglia | 297/284 |
| 4,153,293 | 5/1979 | Sheldon | 297/284 |
| 4,156,544 | 5/1979 | Swenson et al. | 297/284 |

FOREIGN PATENT DOCUMENTS

| | | | |
|---|---|---|---|
| 1805997 | 6/1970 | Fed. Rep. of Germany | 297/284 |
| 1399285 | 7/1975 | United Kingdom | 297/284 |

*Primary Examiner*—Francis K. Zugel

*Attorney, Agent, or Firm*—Wolf, Greenfield & Sacks

[57] ABSTRACT

A back rest construction which may be incorporated into an upholstered chair or recliner, or which may be used in a portable back rest either alone or in combination with a seat. The construction includes a frame with a vertical track carried on it and which in turn carries a lumbar support that may be moved up and down on the track. The lumbar support not only may be moved vertically to adjust its height, but in addition, it may be moved toward and away from the plane of the frame so as to decrease or increase the support provided by it.

4 Claims, 8 Drawing Figures

ADJUSTABLE BACK REST

INTRODUCTION

This invention relates to the construction of back rests and more particularly comprises a new and improved back rest assembly that has an adjustable lumbar support. The lumbar support may be adjusted both vertically and horizontally so as to suit the person using it. The construction may be incorporated into either an upholstered chair or recliner, or it may be embodied in a portable unit with or without a seat so that it may be used in motor vehicles or other places. The invention herein disclosed is an improvement over the back rest construction shown in U.S. Pat. No. 4,502,728 having a common assignee with the present application.

The adjustable back rest shown in U.S. Pat. No. 4,502,728 includes a lumbar support made up of a number of parallel, horizontal, spring steel straps that may be raised and lowered on a pair of tracks on the back of the back rest so as to alter the curvature of the back rest. While the lumbar support may be raised and lowered to suit the preference of the user, the back rest shown in the '728 patent does not include means for increasing or diminishing the curvature imposed in the back rest by the lumbar support. Therefore, there is no means by which the user may increase or decrease the support afforded the lumbar area.

The principal object of the present invention is to provide a back rest which not only may be adjusted vertically but which also may be adjusted horizontally so as to increase or decrease the support afforded the user of the back rest.

Another important object of this invention is to provide an adjustable back rest which is dependable, ruggedly constructed, and not expensive to manufacture.

To accomplish these and other objects, the back rest of the present invention includes a relatively rigid frame which may be made of a foam plastic, plywood, metal or some other material, to which a vertical track is secured. The track supports a guide made of spring steel and which in turn carries a lumbar support. Adjusting means are connected between the track and guide for moving the guide and the lumbar support toward and away from the track to diminish or increase the curvature introduced to the back rest by the lumbar support. The adjusting means also causes the guide to frictionally engage the track in a manner which permits the guide to be moved vertically on the track and enable it to remain in any position in which it is placed by the user.

These and other object and features of the present invention will be better understood and appreciated from the following detailed description read in connection with the accompanying drawings.

BRIEF FIGURE DESCRIPTION

DETAILED DESCRIPTION

Figure 1:
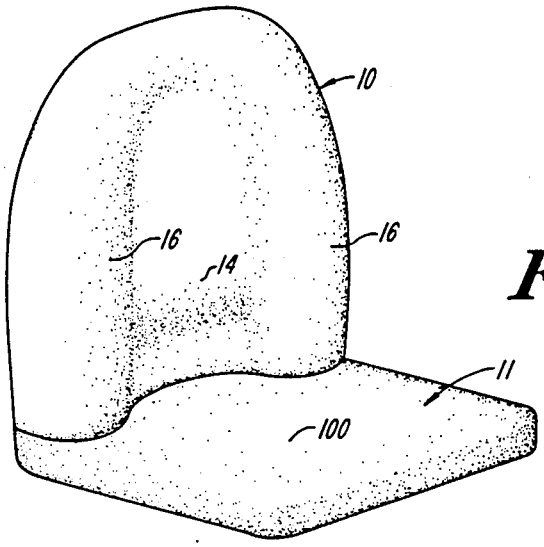
FIG. 1 is a perspective view of a back rest and seat combination having an adjustable lumbar support, constructed in accordance with this invention.
Figure 7:
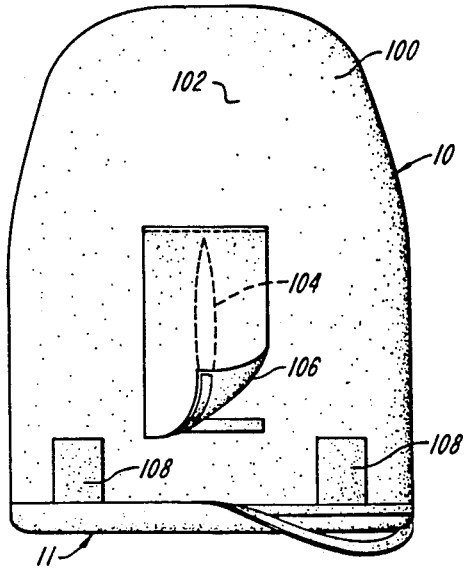
FIG. 7 is a rear view of the seat and back combination shown in FIG. 1.

The back rest 10 shown connected to seat 11 in FIGS. 1 and 7 is built about a frame 12 made of a rigid foam plastic material such as polyethylene, having a density of approximately two pounds per cubic foot. While foam plastic is shown and has many advantages, the frame may also be made of wood, plywood, sheet metal, tubular metal or combinations thereof. The frame member 12 may either be flat or gently curved about its vertical center line so as to be concave in a horizontal plane toward the front of the back rest. In the following description reference is made to the central portion 14 and sides 16 of the frame identified in FIG. 1.

Figure 2:
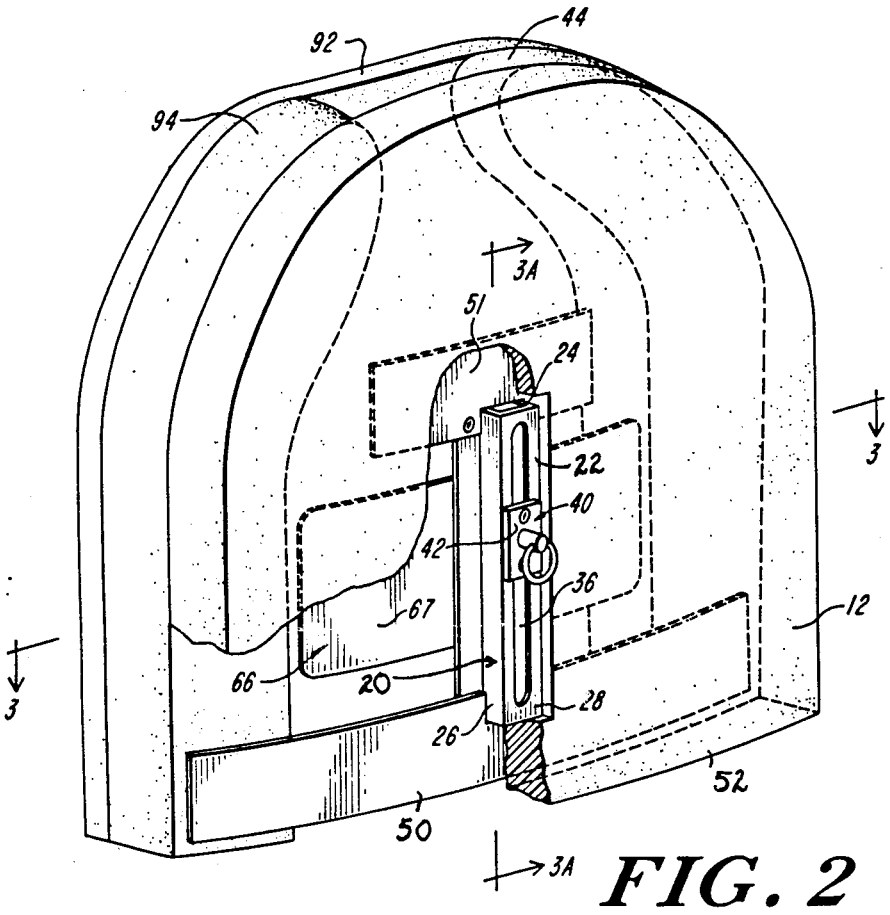
FIG. 2 is perspective view of a portion of the back rest shown in FIG. 1 with the fabric cover removed and with the adjusting means of the lumbar support exposed.
Figure 3A:
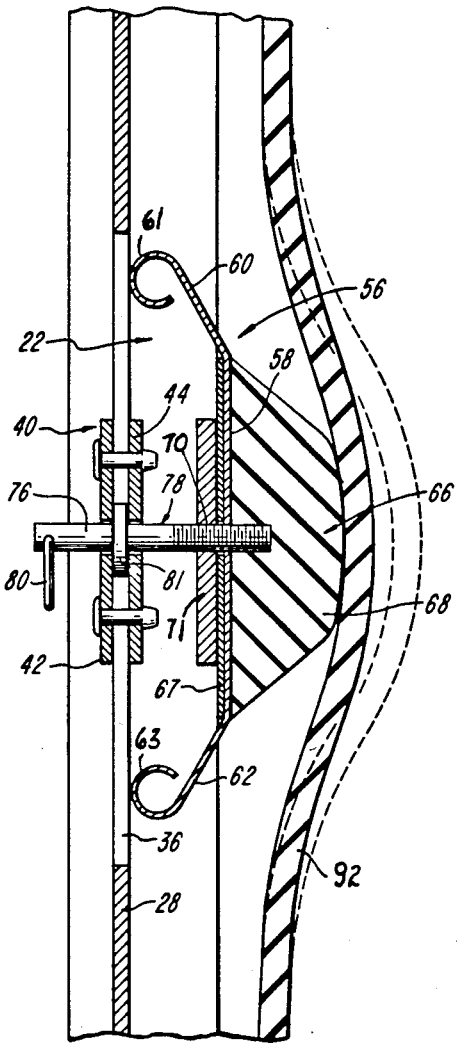
FIGS. 3 and 3A are horizontal and vertical cross-sectional views, respectively, of the back rest taken along the corresponding section lines in FIG. 2.
Figure 3:
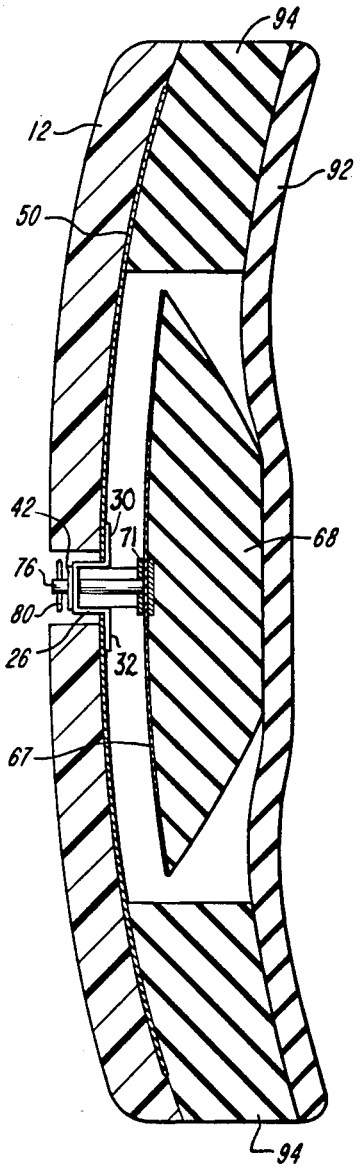
Figure 5:
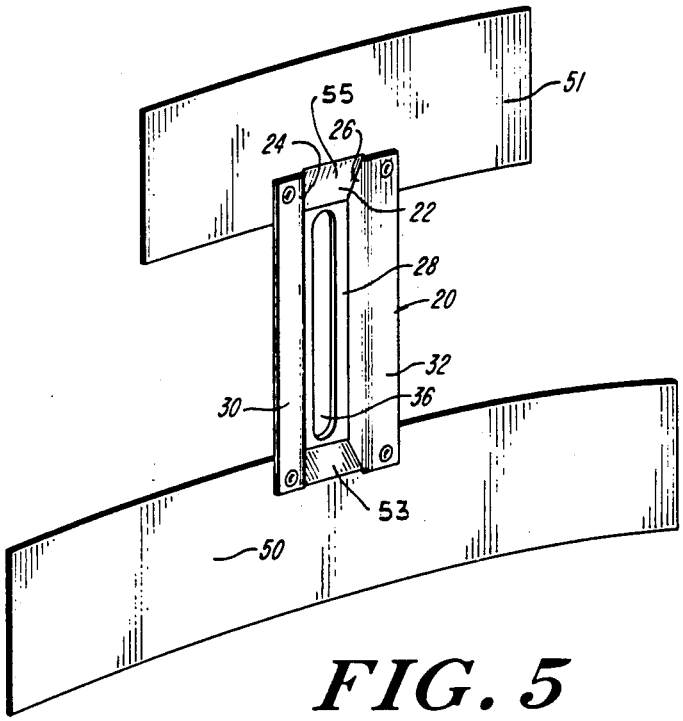
FIG. 5 is a perspective view of the back rest adjusting mechanism.

A vertical track 20 shown in FIGS. 2, 3, 3A, 5 and 6 is imbedded in the front side of the central portion 14 of frame member 12 and extends through a substantial portion of the total height of the frame member. The track 20 is made of steel or some other material of comparable strength and includes a channel 22 defined by side walls 24 and 26 and rear wall 28. The track also includes a pair of outwardly extending flanges 30 and 32 forming continuations of the side walls 24 and 26, respectively. As shown in FIGS. 3 and 5, the flanges 30 and 32 lie essentially in the plane of the front face 34 of the frame 12. The rear wall 28 of the track channel has a vertical slot 36 which extends substantially the full length of the track.

Figure 6:
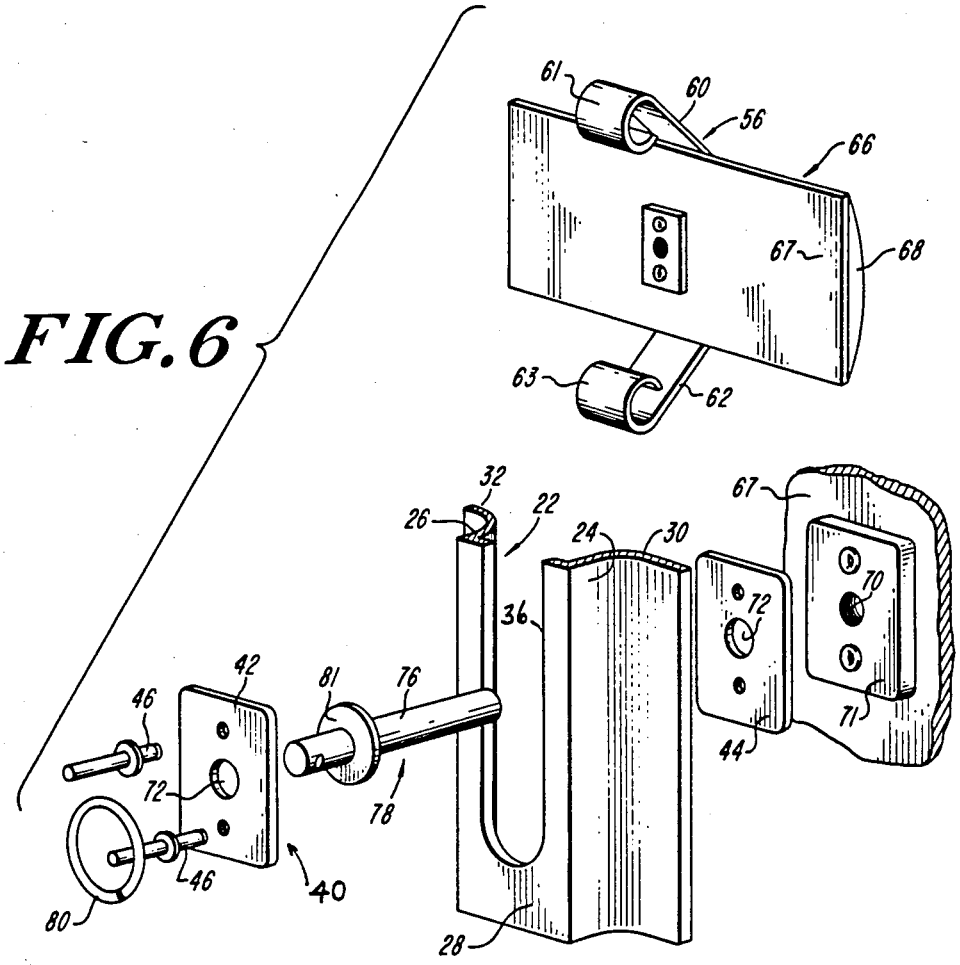
FIG. 6 is an exploded, fragmentary, perspective view of the adjusting mechanism and the lumbar support.

Track 20 supports a slide 40 shown in detail in FIGS. 2, 3A and 6. The slide includes a pair of small rectangular plates 42 and 44 that lie on the rear and front sides of the rear wall 28 of the track and are secured together by rivets 46 that extend through slot 36. The track 20 is riveted to a base plate 50 and top plate 51, as shown in FIGS. 2 and 5, and the two are cemented or otherwise secured to the frame member 12. Base plate 50 is secured to the frame 12 adjacent the bottom edge 52 thereof.

Figure 4:
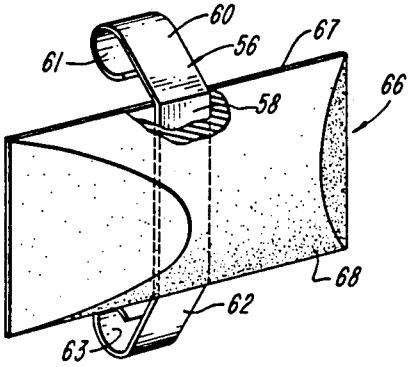
FIG. 4 is a perspective view of the lumbar support viewed from the front and with part of the support cushion broken away to illustrate details of the construction.

As shown in FIGS. 3A, 4 and 6 a wing-shaped guide 56 engages and slides within the channel 22 of the track. The guide 56 includes a central section 58 and a pair of diverging arms 60 and 62 that extend rearwardly from the central section 58 and rest against the front surfaces of either the bottom wall 28 of the channel 22 or the plates 50 and 51. The central section 58 of guide 56 in turn carries the lumbar support 66. The diverging arms 60 and 62 are scrolled at their ends 61 and 63 so as to function as smooth runners in the channel 22 and on the plates 50 and 51. The curved outer surfaces of the scrolls will slide without binding on the surface of wall 28 or hanging up on the sides 24 and 26 of the channel. It will also be noted that the sides 24 and 26 of the channel 22 are flared so as to prevent the arms 60 and 62 from hanging up on the channel sides. Moreover, ramps 53 and 55 are formed by the plates 50 and 51 at the ends of the track to enable the ends 61 and 63 of the arms to glide out of the channel and onto the plates. As is evident from the drawing, one or the other of end 61 or 63 always is positioned in the track regardless of the position of the lumbar support.

The guide 56 is made of spring steel and therefore possesses substantial strength although it is somewhat flexible. The lumbar support 66 is shown to have a thin backer 67 made of spring steel, and is of the same planar configuration as frame 12. That is, if the frame is flat, the backer 67 is also flat, and if the frame is curved about its vertical center line, the backer 67 will also have that configuration. The backer 67 in turn carries a foam lumbar pad 68 on its front surface which provides the direct lumbar support for the party using the back rest.

The orientation of the lumbar support within the back rest is clearly shown in FIGS. 2, 3 and 3A. Typically, the lumbar support 66 may be 10 inches in length, 5⅜ inches in height and 1½ inches thick. The central portion 58 of the guide may be secured to the front surface of the backer 67 by rivets, welding or any other means.

In FIGS. 3A and 6, a threaded hole 70 is shown formed in block 71 secured to the backer 67 of lumbar support 66. The threaded hole 70 as well as the holes 72 in the plates 42 and 44 receive the shaft 76 of adjusting screw 78. The screw 78 carries a ring 80 on its outer end 82 so that it may be easily turned. Obviously, a knob or other easily grasped handle may be used in place of the ring. It will be noted in FIGS. 3A and 6 that screw 78 carries a flange 81 sandwiched between plates 42 and 44 so that the screw may turn without moving axially with respect to the track. The lumbar support 66 may be moved toward and away from the track as the screw rotates and takes up or plays out the guide 56 by virtue of the threaded hole 70 in block 71 which receives the screw. The screw 78 also serves to retain the lumbar support and its guide 56 on the track 20. The biased configuration of the guide 56 is such that the ends 61 and 63 of the guide bear against the front surface of the rear wall 28 of the track and/or the plates 50 or 51 so as to frictionally hold the lumbar support in whatever position it is placed by the user. The sliding of the guide in the track may be made somewhat easier by loosening the screw 78, but at all times at least one of the ends 61 and 63 of the guide bears against the front surface of the rear wall 28 of the track depending upon the height of the support 66 so as to prevent the lumbar support from shifting vertically (or from side to side) unless, of course, the user intentionally changes its position. The guide 56 with the lumbar support 66 may be raised and lowered simply by engaging the ring 80 on the adjusting screw and pulling it up or down. The horizontal position of the lumbar support 66 with respect to the front face 34 of the frame member 12 may be varied by loosening or tightening the adjusting screw 78. When the screw is turned in a direction so as to cause its threads to move deeper into the threaded hole 70 in the block 71 and the lumbar support 66, the arms 60 and 62 may be flattened somewhat so as to draw the lumbar support 66 closer to the front face of the frame member. On the other hand, when the screw 78 is turned in the opposite direction, the lumbar support 66 will move further away from the front face 34 of the frame member as suggested by the broken line position of the lumbar support in FIG. 3A. This facility enables the user to adjust the projection of the lumbar support with respect to the plane of the frame so as to provide maximum support for the user.

As shown in FIGS. 3, 3A and 4, the lumbar support 66 includes the soft foam pad 68 which may be cemented or otherwise adhered to the front surface of the backer 67. The entire front surface 34 of the frame member 12 as well as the lumbar support 66 and its foam pad 68 are covered by a soft foam cushion 92 of polyurethane or similar material. As suggested in FIG. 2, vertically oriented strips 94 of soft foam may be secured along the vertical side edges of the front of the frame 12 to provide a horizontal curvature to the cushion, that is, a contoured configuration which conforms to the body shape of the user. To further promote smooth and easy vertical adjustment of the lumbar support 66, a thin polyethylene film (not shown) may be cemented to the back of cushion 92 and engage the lumbar pad, to reduce friction.

In FIGS. 1 and 7, the back rest 10 and seat 11 are shown covered by fabric 100. The fabric back 102 of the back rest is provided with a slit 104 which in turn is covered by a removable flap 106 held in place by Velcro or other appropriate means. When the flap 106 is removed, the slit 104 exposes the adjusting screw 78 and its ring 80 so that the lumbar support may be adjusted in or out and up or down on the frame to provide the support desired by the user. Fabric hinges 108 made of Velcro or other material may also be provided to removably interconnect the back rest and seat.

From the foregoing description, it is apparent that both the position of the lumbar support and the lumbar curvature introduced into the back rest may be adjusted to suit the user. The lumbar support may be raised and lowered on the track 20 so as that lumbar curvature may be placed at the desired elevation merely by sliding the adjusting screw 78 and slide 40 up and down on the track 20. Furthermore, the extent of the curvature provided by the lumbar support, regardless of its vertical position, may also be readily adjusted. The single adjusting screw 78 enables the user to extend or retract the lumbar support so as to modify the curvature introduced into the back rest as suggested by the two positions of the lumbar support shown in full and broken lines in FIG. 3A.

The foregoing description and drawings present the back rest of this invention as part of a back and seat combination. It will be appreciated that the invention described may readily be incorporated into an upholstered chair as an integral part thereof, or the back rest may be used alone, without a seat, as a portable device suitable for use on any chair, recliner, or other type of seat either fixed or in a vehicle so as to provide the appropriate lumbar support for the user.

Having described this invention in detail, those skilled in the art will appreciate that numerous modifications may be made thereof without departing from its spirit. Therefore, it is not intended that the breadth of this invention be limited to the specific embodiments illustrated and described. Rather, the scope of this invention is to be determined by the appended claims and their equivalents.

What is claimed is:

1. A back rest comprising a relatively rigid frame having a front and back, lower end and central portion, a horizontal base plate secured to the lower end of the frame, a vertical track secured at its lower end to the base plate and connected to the central portion of the frame, a guide mounted on and movable up and down on the track, said guide being a vertically elongated member made of spring steel and with at least one of its ends mounted in the track and its central portion being spaced forwardly from the track, a horizontally extending lumbar support disposed in front of the frame and carried by the central portion of the guide and movable up and down with the guide, adjusting means carried on the track for moving the central portion of the guide toward and away from the track so as to adjust the distance of the lumbar support from the front of the frame, said adjusting means being connected to the central portion of the guide so as to move that portion and the lumbar support toward and away from the front of the frame, cushioning means covering the front of the frame and lumbar support, and a cover fabric enclosing the frame, lumbar support, track and guide.

2. A back rest as defined in claim 1 further characterized by said guide engaging the track and remaining in any position in which it is placed with respect thereto by the frictional contact between them.

3. A back rest as defined in claim 1 further characterized by said track being U-shaped in cross-section and open to the front, said track having a base and side flanges, an elongated vertical slot through the base, a slide including a pair of plates, one on the front and one on the back of the base, and a screw extending through the pair of plates and slot in the base and engaging the guide to move it toward and away from the track, said slide and screw comprising said adjusting means.

4. A back rest comprising a frame having a front surface;

a vertical track carried on the frame, said track being a U-shaped channel open to the front surface of the frame, said track having a base and side flanges and including an elongated vertical slot through the base;

lumbar support means including a pad carried on and movable up and down on the track, said lumbar support means including a guide made of spring steel having at least one end which extends into and slides in the channel and a central portion which supports the pad, the central portion being spaced from and movable toward and away from the track; and adjusting means connected to the lumbar support means for moving it generally horizontally toward and away from the front surface of the frame to vary the forward projection of the lumbar support from the front surface of the frame, said adjusting means having a slide including a pair of plates, one on the front and one on the back of the track base, and a screw extending through the pair of plates and the slot in the base and engaging the guide to move it toward and away from the track, said screw being provided with a flange sandwiched between the plates so that the screw turns without moving axially with respect to the track.

* * * * *